US008727326B2

(12) United States Patent
Lin

(10) Patent No.: US 8,727,326 B2
(45) Date of Patent: May 20, 2014

(54) ASSEMBLY JIG

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 240 days.

(21) Appl. No.: 13/426,537

(22) Filed: Mar. 21, 2012

(65) Prior Publication Data

US 2013/0249155 A1 Sep. 26, 2013

(51) Int. Cl.
*B25B 11/02* (2006.01)

(52) U.S. Cl.
USPC ..... 269/8; 439/38; 29/464

(58) Field of Classification Search
CPC ..... B25B 11/02; B25B 11/002; H01H 36/00; B23P 19/04
USPC ..... 269/8; 439/38–40; 29/464, 559
See application file for complete search history.

(56) References Cited

U.S. PATENT DOCUMENTS

| | | | | | |
|---|---|---|---|---|---|
| 1,343,751 | A * | 6/1920 | Simmons | 335/287 |
| 2,269,149 | A * | 1/1942 | Edgar | 335/295 |
| 2,552,152 | A * | 5/1951 | Conley | 409/309 |
| 3,009,225 | A * | 11/1961 | Budreck | 24/303 |
| 3,041,697 | A * | 7/1962 | Budreck | 24/303 |
| 3,061,919 | A * | 11/1962 | Tack | 29/428 |
| 3,210,068 | A * | 10/1965 | Shelton | 269/8 |
| 5,287,028 | A * | 2/1994 | Suzuki et al. | 310/71 |
| 5,525,950 | A * | 6/1996 | Wang | 335/288 |
| 5,581,179 | A * | 12/1996 | Engel et al. | 324/207.2 |
| 7,204,695 | B1 * | 4/2007 | Shiu et al. | 439/38 |
| 7,517,222 | B2 * | 4/2009 | Rohrbach et al. | 439/39 |
| 8,241,043 | B1 * | 8/2012 | Lin | 439/39 |
| 8,465,296 | B1 * | 6/2013 | Lin et al. | 439/39 |
| 8,613,432 | B2 * | 12/2013 | Chou et al. | 269/8 |
| 2002/0101311 | A1 * | 8/2002 | May, III | 335/205 |
| 2002/0135449 | A1 * | 9/2002 | Menard | 335/289 |
| 2006/0139134 | A1 * | 6/2006 | Hunts | 335/205 |

* cited by examiner

*Primary Examiner* — George Nguyen
(74) *Attorney, Agent, or Firm* — WPAT, P.C.; Anthony King

(57) ABSTRACT

An assembly jig used for assembling a magnet connector including a magnetic body includes a magnet, and a base body having a rear surface and a front surface. The front surface is concaved rearward to form a holding room. The rear surface is concaved forward to form a receiving cavity having a shape in accordance with the external outline of the magnetic body. The magnet is held in the holding room of the base body with the magnetic poles thereof being located in a kind of only certain way. When assembling the magnet connector, the magnetic body is partly attracted in the receiving cavity of the base body by the magnet and then is assembled to the magnet connector with the magnetic poles thereof being uniformly arranged in a kind of only certain way after mass production of the magnet connector.

1 Claim, 4 Drawing Sheets

ASSEMBLY JIG

BACKGROUND OF THE INVENTION

1. Field of the Invention

The present invention relates to an assembly jig, and more particularly to an assembly jig used for assembling a magnet connector.

2. The Related Art

With the development of science and technology, a magnet connector and its mating connector were created as the times require. The magnet connector generally includes a magnetic body, and its mating connector generally has a mating magnet therein. In use, the interconnection between the magnet connector and its mating connector is achieved by magnetic attraction of the magnetic body and the mating magnet. In general, the magnetic poles of the magnetic body are symmetric in shape structure. During mass production of the magnet connector, the magnetic bodies are required to be assembled in the magnet connectors with all of the magnetic poles keeping uniform with one another in the magnet connectors. However, in the process of assembling the magnet connector, it is difficult for workers to judge the magnetic poles on account of the symmetric shape of the magnetic body. As a result, the magnetic poles of the magnetic bodies often fail to be uniform with one another in the magnet connectors after finishing the mass production of the magnet connector. Consequently, the magnetic body must be disassembled from the magnet connector and then reassembled to form the magnet connector over again. It seriously affects productivity of the magnet connector and takes a lot of manpower, work hours and production costs. So, an assembly jig capable of overcoming the foregoing problems is required.

SUMMARY OF THE INVENTION

Accordingly, an object of the present invention is to provide an assembly jig used for assembling a magnet connector which includes a magnetic body. The assembly jig includes a magnet, and a base body having a rear surface and a front surface. The front surface is concaved rearward to form a holding room. The rear surface is concaved forward to form a receiving cavity having a shape in accordance with the external outline of the magnetic body of the magnet connector. The magnet is held in the holding room of the base body with the magnetic poles thereof being located in a kind of only certain way. When assembling the magnet connector, the magnetic body is partly attracted in the receiving cavity of the base body by the magnet and then is assembled to the magnet connector with the magnetic poles thereof being uniformly arranged in a kind of only certain way after mass production of the magnet connector.

As described above, the magnet is held in the holding room of the base body with the magnetic poles thereof being located in a kind of only certain way. So, by using the assembly jig of the present invention, the magnetic poles of the magnetic bodies could be uniformly arranged in a kind of only certain way after mass production of the magnet connector. So, it effectively saves manpower, work hours and production costs, and further improves productivity of the magnet connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 6:
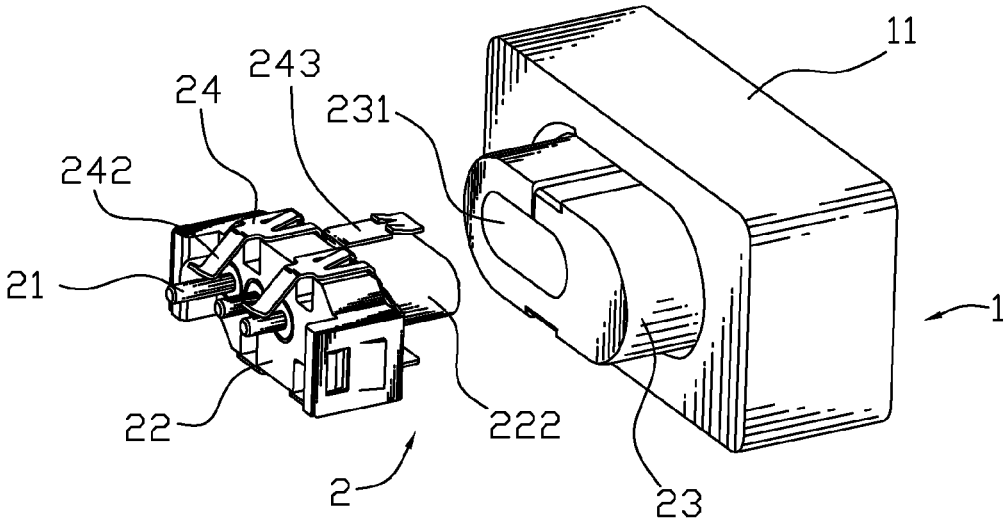
FIG. 6 is a using state view showing that the assembly jig of FIG. 3 is used for assembling the magnet connector of FIG. 1.

Referring to FIG. 6, an assembly jig 1 according to an embodiment of the present invention is used for assembling a magnet connector 2.

Figure 1:
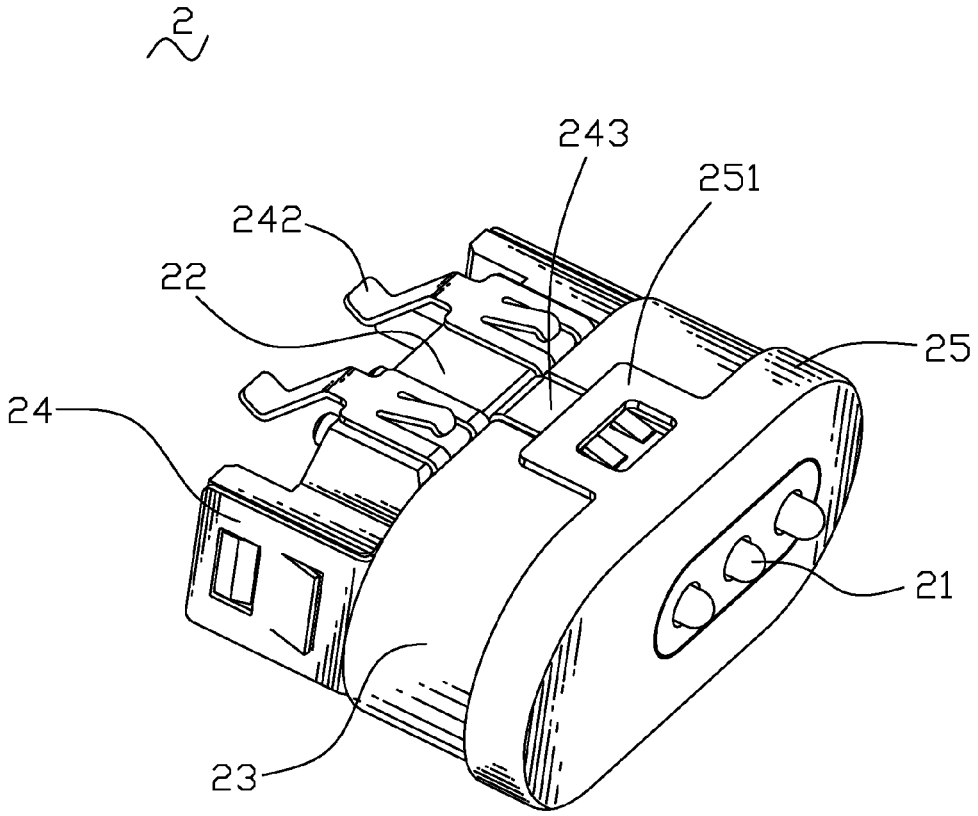
FIG. 1 is an assembled perspective view of a magnet connector which could be assembled with an assembly jig of the present invention.
Figure 2:
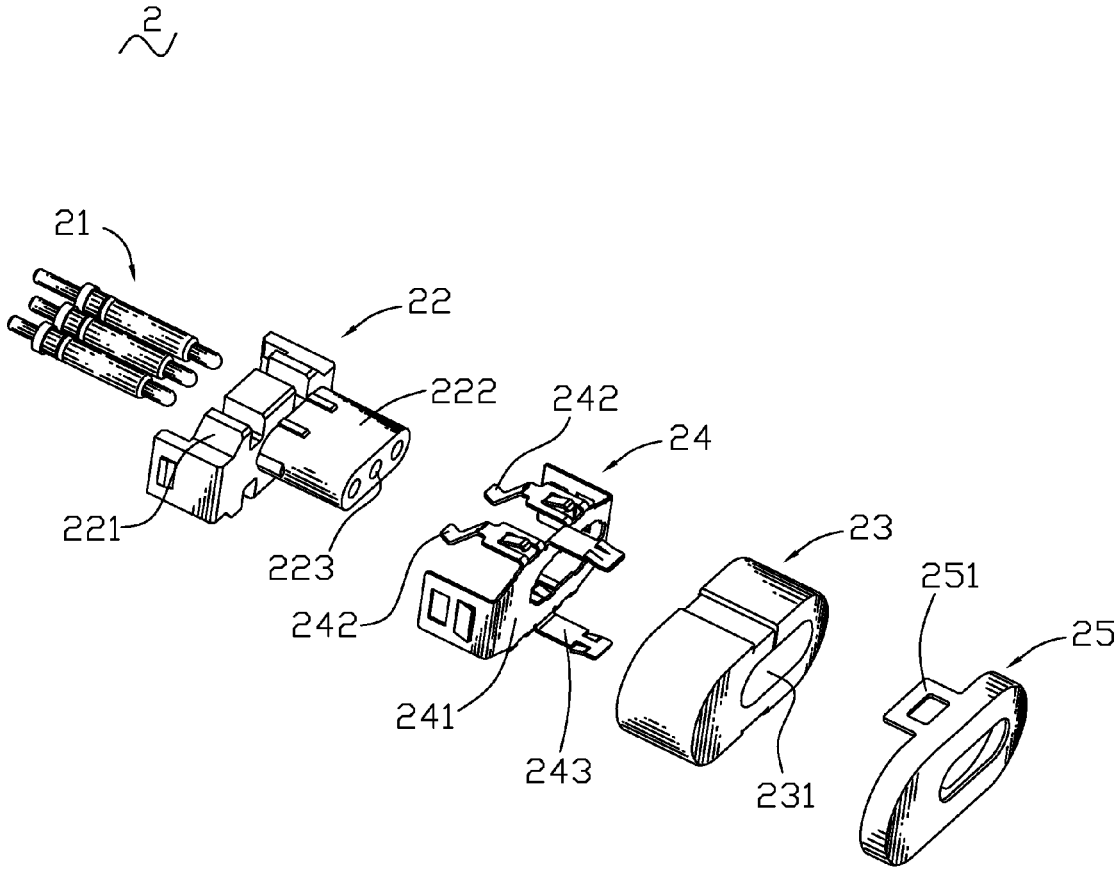
FIG. 2 is an exploded perspective view of the magnet connector of FIG. 1.
Figure 3:
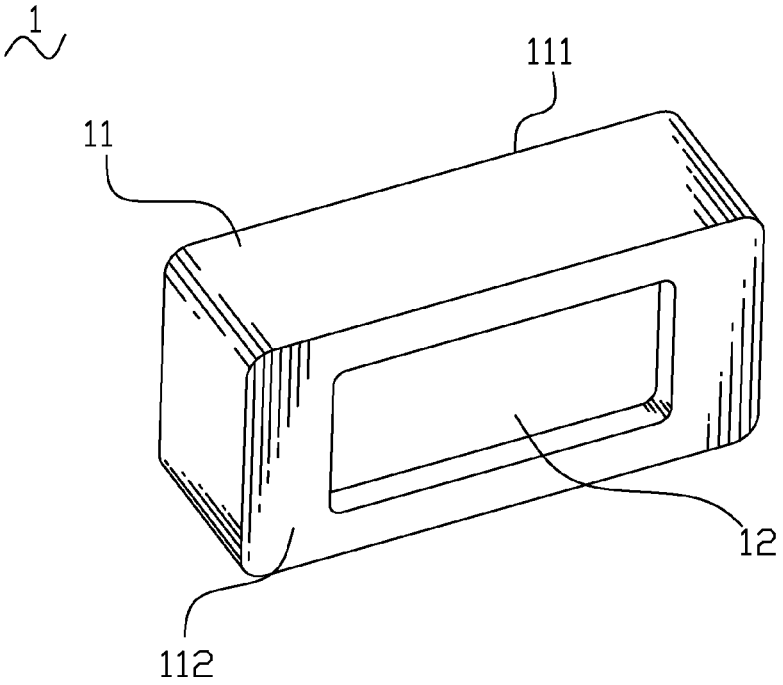
FIG. 3 is an assembled perspective view of the assembly jig according to an embodiment of the present invention.
Figure 4:
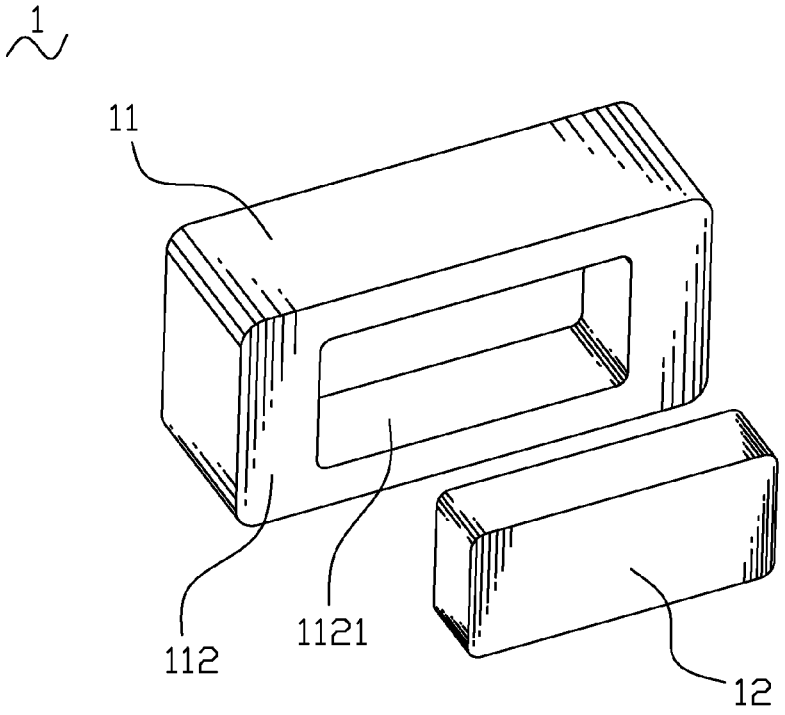
FIG. 4 is an exploded perspective view of the assembly jig of FIG. 3.
Figure 5:
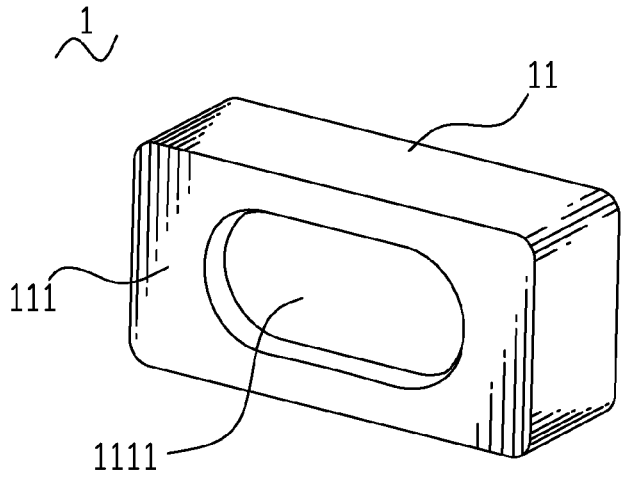
FIG. 5 is another angle of assembled perspective view of the assembly jig of FIG. 3.

Referring to FIG. 1 and FIG. 2, the magnet connector 2 includes an insulating housing 22, a plurality of probe pins 21, a magnetic body 23 and a metal shell. The insulating housing 22 has a base 221 and a tongue 222 extending forward from a front of the base 221. The insulating housing 22 defines a plurality of inserting grooves 223 longitudinally penetrating through the base 221 and the tongue 222. The probe pins 21 are inserted forward in the inserting grooves 223 respectively. The magnetic body 23 is of a unitary block and defines an inserting hole 231 penetrating longitudinally therethrough and matching with the tongue 222 of the insulating housing 22.

Referring to FIGS. 3-6, the assembly jig 1 includes a magnet 12 and a base body 11 having a rear surface 111 and a front surface 112. The front surface 112 is concaved rearward to form a holding room 1121. The rear surface 111 is concaved forward to form a receiving cavity 1111 having a shape in accordance with the external outline of the magnetic body 23 of the magnet connector 2. The magnet 12 is held in the holding room 1121 of the base body 11 with the magnetic poles thereof being located in a kind of only certain way. When assembling the magnet connector 2, the magnetic body 23 is partly attracted in the receiving cavity 1111 of the base body 11 by the magnet 12 and then is put around the tongue 222 of the insulating housing 22 through the inserting hole 231. By using the assembly jig 1, the magnetic poles of the magnetic bodies 23 could be uniformly arranged in a kind of only certain way after mass production of the magnet connector 2.

Referring to FIGS. 1-2 again, the metal shell includes a first metal shell 24 and a second metal shell 25. The first metal shell 24 has a front plate 241 passing through the tongue 222 to abut against the front of the base 221. Top and bottom edges of the front plate 241 protrude rearward to form a plurality of touching arms 242 clamping the base 221 therebetween, and extend forward to form a pair of connecting plates 243 attached on a top and a bottom of the magnetic body 23. The second metal shell 25 is covered to a front of the magnetic body 23 after the assembly jig 1 assembles the magnetic body 23 to the tongue 222, and has a pair of locking parts 251 connecting and buckling with the connecting plates 243 to clamp the magnetic body 23 among the metal shell.

As described above, the magnet 12 is held in the holding room 1121 of the base body 11 with the magnetic poles thereof being located in a kind of only certain way. When assembling the magnet connector 2, the magnetic body 23 is partly attracted in the receiving cavity 1111 of the base body

11 by the magnet 12 and then is assembled around the tongue 222 of the insulating housing 22. By using the assembly jig 1, the magnetic poles of the magnetic bodies 23 could be uniformly arranged in a kind of only certain way after mass production of the magnet connector 2. So, it effectively saves manpower, work hours and production costs, and further improves productivity of the magnet connector 2.

What is claimed is:

1. An assembly jig used for assembling a magnet connector which includes a magnetic body, comprising:

a magnet; and a base body having a rear surface and a front surface, the front surface being concaved rearward to form a holding room, the rear surface being concaved forward to form a receiving cavity having a shape in accordance with the external outline of the magnetic body of the magnet connector, wherein the magnet is held in the holding room of the base body with the magnetic poles thereof being located in a kind of only certain way, when assembling the magnet connector, the magnetic body is partly attracted in the receiving cavity of the base body by the magnet and then is assembled to the magnet connector with the magnetic poles thereof being uniformly arranged in a kind of only certain way after mass production of the magnet connector, wherein the magnet connector further includes an insulating housing, a plurality of probe pins and a metal shell, the insulating housing has a base and a tongue extending forward from a front of the base, the insulating housing defines a plurality of inserting grooves longitudinally penetrating through the base and the tongue, the probe pins are inserted forward in the inserting grooves respectively, the magnetic body is of a unitary block with an inserting hole penetrating longitudinally therethrough to match with the tongue of the insulating housing, the assembly jig puts the magnetic body around the tongue through the inserting hole, the metal shell encloses the insulating housing and the magnetic body.

* * * * *